US005752324A

United States Patent [19]

Muller et al.

[11] Patent Number: 5,752,324

[45] Date of Patent: May 19, 1998

[54] STEAM BLOWER BOX

[75] Inventors: Dieter Muller, Sontheim; Markus Oechsle, Bartholoma, both of Germany

[73] Assignee: Voith Sulzer Papiermaschinen GmbH, Germany

[21] Appl. No.: 710,484

[22] Filed: Sep. 18, 1996

[51] Int. Cl.[6] ..... D21F 5/00

[52] U.S. Cl. ..... 34/114; 34/119; 34/124

[58] Field of Search ..... 34/114, 117, 119, 34/122, 124, 130, 131, 132, 632, 629, 633, 636, 638

[56] References Cited

U.S. PATENT DOCUMENTS

| | | | |
|---|---|---|---|
| 3,945,570 | 3/1976 | Dove | 239/135 |
| 4,351,700 | 9/1982 | Dove | 34/114 X |
| 4,867,054 | 9/1989 | Taylor | 100/93 |
| 4,899,463 | 2/1990 | Heikkilä et al. | 34/114 X |
| 4,945,654 | 8/1990 | Mason | 34/119 X |
| 5,282,323 | 2/1994 | Winheim | 34/155 |

FOREIGN PATENT DOCUMENTS 4125062 4/1993 Germany .

*Primary Examiner*—Henry A. Bennett
*Assistant Examiner*—Steve Gravini
*Attorney, Agent, or Firm*—Ostrolenk, Faber, Gerb & Soffen, LLP

[57] ABSTRACT

The invention relates to a steam blower box for the application of steam onto a material web passing by, for example onto a paper web that is to be dewatered and is passing through the press section of a paper-manufacturing machine. The steam blower box extends, transverse to the web travel direction, over the entire web width and comprises a plurality of zone chambers, that are arranged side by side over the web width and are covered by a perforated steam exit panel. Each zone chamber is connected to a steam source via a control valve of its own. The steam exit panel can be removed for purposes of cleaning the zone chambers. Each of the zone chambers comprises a perforated panel insert which is likewise removable.

7 Claims, 5 Drawing Sheets

STEAM BLOWER BOX

CROSS-REFERENCE TO RELATED APPLICATIONS

This is a continuation-in-part of International Application PCT/DE95/00061, with an international filing date of Jan. 19, 1995.

BACKGROUND OF THE INVENTION

The present invention relates to a steam blower box for the application of steam onto a moving material web, for example onto a paper web that is to be dewatered and is passing through the press section of a paper-manufacturing machine. Reference is made to German published application DE 41 25 062 A1.

A steam blower box of this kind is utilized primarily in paper manufacturing. Its purpose is, with the aid of the steam applied onto the material web, to raise the temperature of the material web in order to increase the dewatering performance of the press section. The steam blower box offers the possibility of influencing the transverse moisture profile of the material web by sectionally varying steam application.

In the known design, steam emerging from the sectional chambers (or "zone chambers") is controlled by valves that are arranged inside the steam blower box. Each correction zone is fitted with a separate, generally pneumatically controlled valve.

It is a disadvantage of this arrangement that any contamination of the zone chambers of the steam blower box (that may be caused, for example, by introduced fibrous material particles) can be removed with the known constructions only in a time-consuming and costly way.

SUMMARY OF THE INVENTION

It is the object of the invention to provide an apparatus of the type described above where cleaning and maintenance of the steam blower box can be effected at lower cost than was possible heretofore. According to the invention, the steam exit panel of the steam blower box and—if present—the perforated panel inserts provided in the zone chambers are given a removable design for easier cleaning. Further, the steam exit panel is perforated and the panel is oriented so that the steam flowing out the perforations in the exit panel is inclined toward the web and upstream of the direction of web travel.

According to a preferred embodiment of the invention, the following provisions are made:

The steam is fed from a main steam line to a steam distributor that is arranged outside the paper-making machine, preferably alongside the paper-making machine, for example on the drive side or, for example, in the underfloor, but in any case at a point easily accessible during operation of the machine. The individual control elements (control valves) are arranged on this steam distributor. Each individual zone chamber of the steam blower box is connected to the corresponding control valve via a separate sectional steam line. The parts of the sectional steam lines mounted on the steam blower box end (opposite to the flow direction) outside the steam blower box are on a plate, for example support plate, that is rigidly joined to the steam blower box. Flexible lines between the support plate and the control valves serve to accommodate swiveling movements and to compensate for any thermal elongation of the steam blower box. The valve drives are controlled by electric motors.

SHORT DESCRIPTION OF THE DRAWINGS

The invention will be described below with reference to a preferred exemplified embodiment, in conjunction with the following drawings, in which FIG. 1 is a general view showing transmission of steam to a steam blower box;

DETAILED DESCRIPTION OF THE PREFERRED EMBODIMENTS

Figure 1:
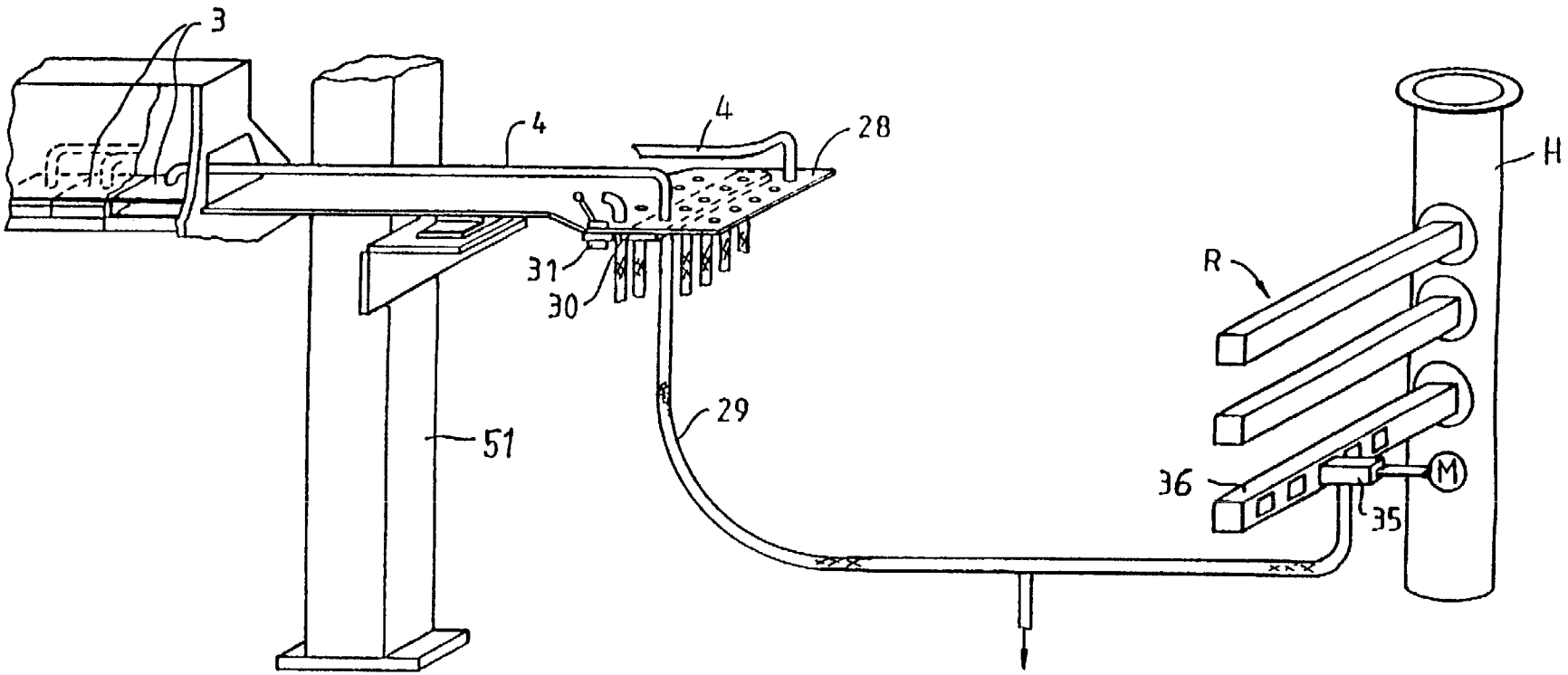
Figure 2:
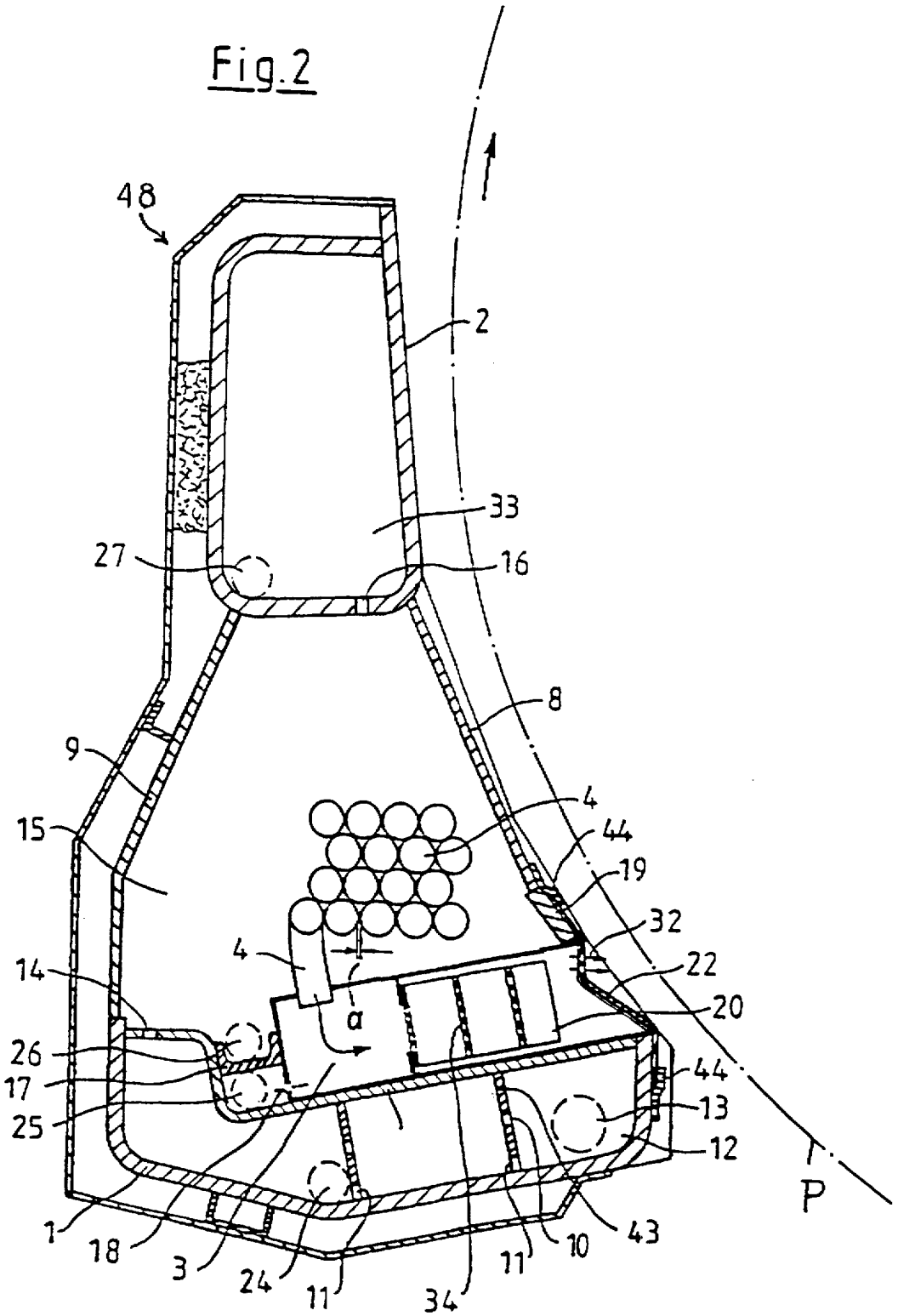
FIG. 2 shows a cross section through a steam blower box.

The steam blower box 48 has of a self-supporting stainless steel structure. It extends, transverse to the web travel direction through the paper-making machine from the guide side to the drive side TS, along the outer surface of a roll which guides paper web P. Only the drive-side end of the steam blower box is shown in FIG. 1. In FIG. 2, webs 43, which have orifices 10 and 11, are welded into and between lower support frames 1, 1'. Lower support frames 1, 1' and an upper support frame 2 are joined to one another via side walls 8 and 9. Optimum transverse stability is achieved with this construction. Support frames 1, 1', and 2 and side walls 8 and 9 delimit a central chamber 15. Through this extends a tube bundle consisting of a plurality of steam lines 4, each of which opens into a respective zone chamber 3 so as thereby to apply "steam I" onto paper web P as it passes by.

Figure 4:
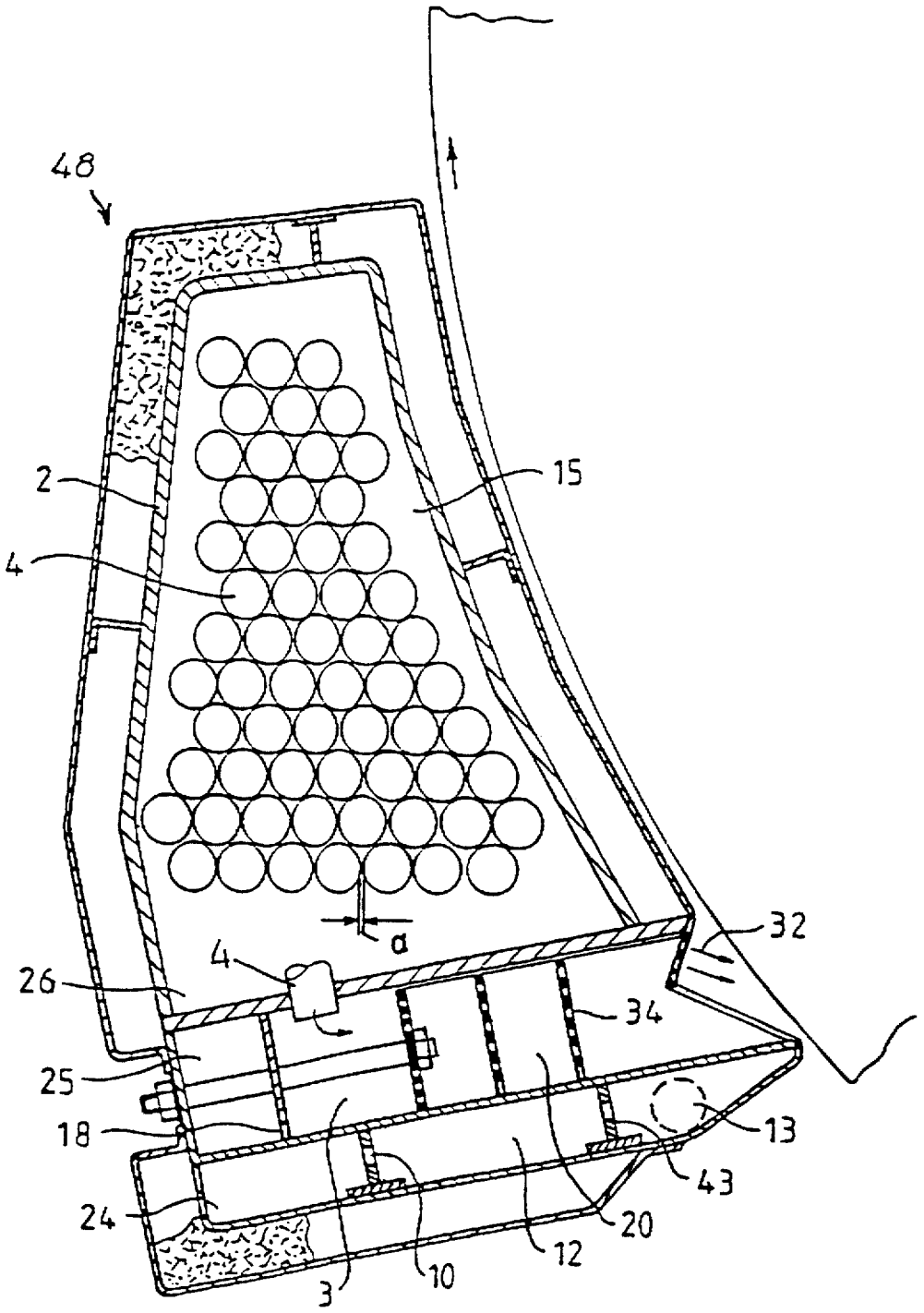
FIGS. 4 shows a cross section different from that of FIG. 2.

A steam conduit 13 opens into lower chamber 12. According to FIG. 1, the preheating steam ("steam II") flowing in here passes through orifices 10 and 14 into chamber 15 which encloses tube bundle 4. This steam II passes lastly through orifices 16 into chamber 33 of support frame 2. In a divergent exemplified embodiment according to FIG. 4, inflowing steam II is guided first through chamber 12 from the drive side to the guide side, and then into the chamber 15. This steam II, whose temperature is greater than steam I inside sectional steam lines 4, ensures that even when the valves to individual steam lines are closed, no cooling of the sectional steam lines 4 or the individual zone chambers 3 occurs. Among the results of this is that little or no condensation forms in the steam lines and in the zone chambers. Moreover a strict separation between steam I and steam II is ensured.

Figure 3:
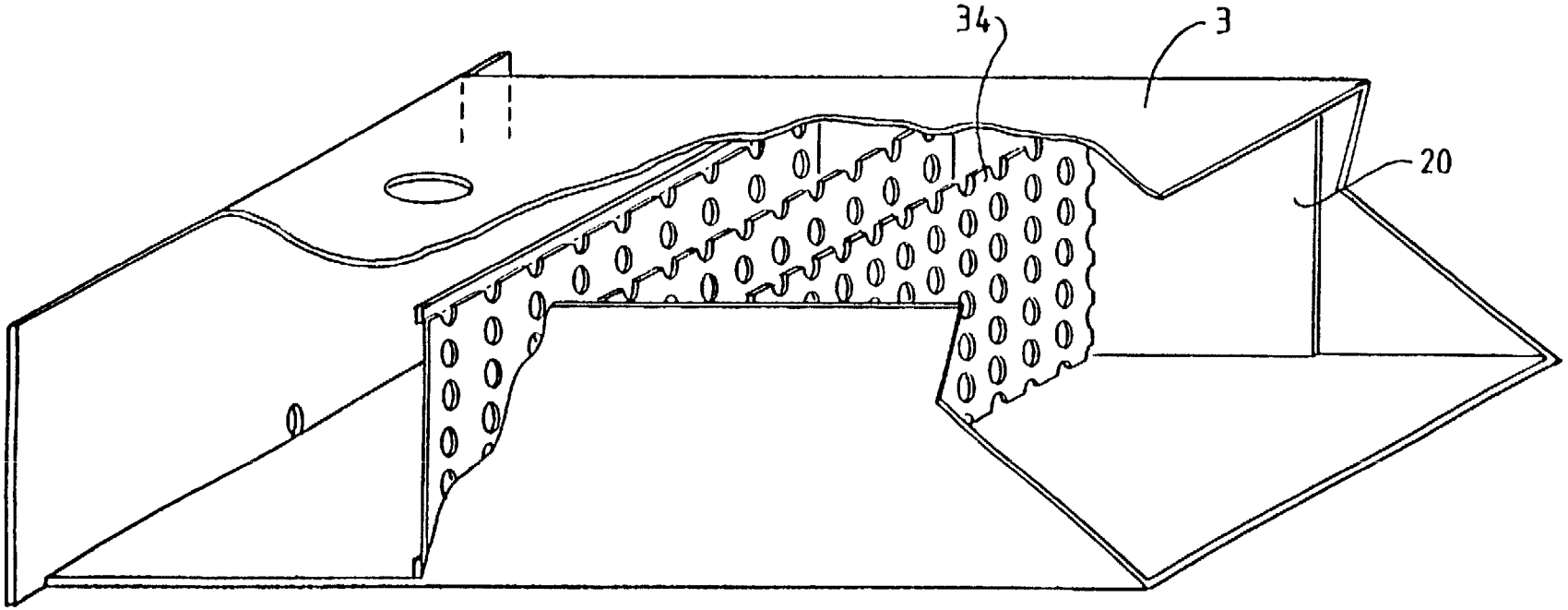
FIG. 3 shows a zone chamber with perforated panel insert.

The individual zone chambers 3 are arranged on lower support frames 1, 1'. They are fastened by means of side panels 19 and 17. A separate steam line 4 opens into each zone chamber. Each zone chamber contains a perforated panel insert 20 with perforated panels 34 whose open cross-sectional area increases toward the steam exit. The effect of these perforated panels 34 is to distribute steam I uniformly over the zone width within the individual zones. The individual perforated panel inserts 20 can be pulled out for maintenance purposes (FIG. 3).

Figure 5:
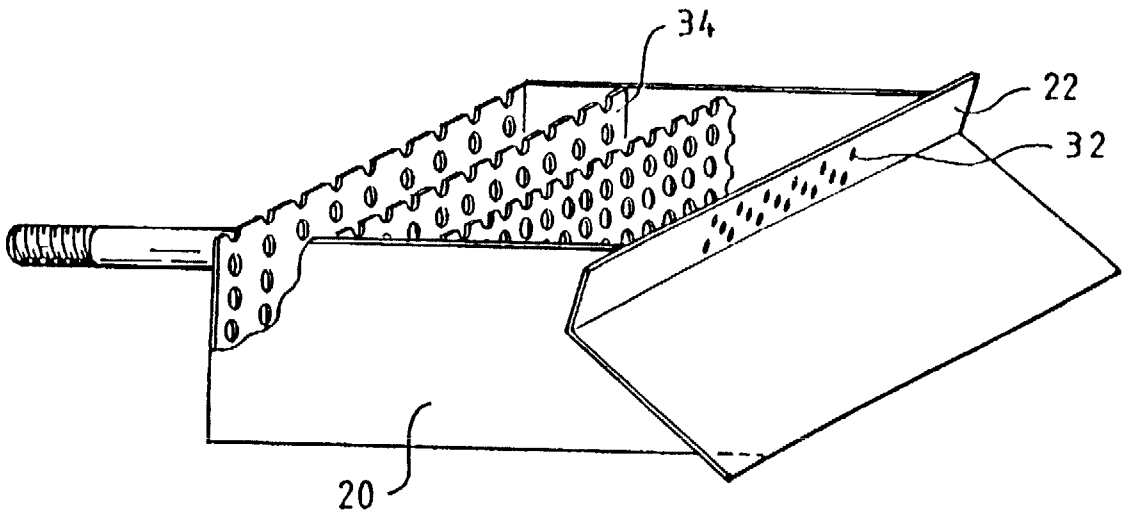
FIG. 5 shows a perforated panel insert for the arrangement shown in FIG. 4.

The individual zone chambers 3 are delimited by one (according to FIG. 2) common steam exit panel 22. This is bolted to panel parts 19 and 1, or fastened by means of guide bars 44, so it can easily be removed for cleaning purposes. It has multiple rows of blower openings 32, arranged behind one another in the longitudinal direction. According to FIGS. 4 and 5, a separate steam exit panel 22' is fastened on each perforated panel insert 20'. The steam exit direction can be perpendicular to the paper travel direction or, according to FIG. 2, inclined so that steam I flows against the web as it arrives. Runoff openings 11, 18, with associated dewatering troughs 24, 25, 26, 27, are provided wherever steam condensation might occur.

According to FIG. 1 the drive-side end of steam blower box 48 rests, by means of a support plate 28 that can be an extension of, for example, lower support frame 1, 1', displaceably on a stand 51. Steam lines 4 are extended outward, opposite to the steam flow direction, beyond the drive-side end of the steam blower box; their inflow ends are, for example, immovably joined to support plate 28. A control element, designated overall as R, is arranged laterally outside the paper-making machine, and comprises for each zone chamber 3 a control valve 35 driven by a stepping motor M. The connection from control valves 35 to support plate 28 is provided by lines 29 that are configured at least partly as flexible lines. Outflow ends 29' of a number of the flexible lines are fastened to a "supply plate" 30. This supply plate is joined by means of quick clamping elements 31 to support plate 28. By means of these quick clamping elements, rapid decoupling is possible in the event of removal of the steam blower box. Control valves 35 are designed so that several of them can be combined next to one another on one steam distribution conduit 36. Steam is supplied to each steam distribution conduit 36 from a main steam line H.

As has been mentioned before, the removable steam exit panel 22 comprises multiple rows of blower openings 32, arranged behind one another in the longitudinal direction. The steam exit direction is opposite to and inclined relative to the paper travel direction. One thereby obtains improved mixing of the steam with the entrained boundary air layer, which increases the steam condensation efficiency on the paper web surface.

We claim:

1. A steam blower box for application of steam onto a paper web passing the steam blower box in a travel direction, the steam blower box comprising:

a plurality of steam zone chambers arranged side-by-side and extending transverse of the web travel direction over the entire width of the web;

a plurality of control valves, each valve for connecting to one of the zone chambers for individual connection of the respective zone chamber to a steam source and whereby the supply of steam to each zone chamber is individually controlled;

each of the zone chambers having an outlet directed generally toward the paper web;

a perforated steam exit panel extending over the outlets from the zone chambers, the steam exit panel being oriented and the perforations thereof being oriented so that the direction toward which steam exits through the perforations is inclined toward the web and opposite from the web travel direction; and an attachment for removably fixing the steam exit panel to the steam blower box.

2. The steam blower box according to claim 1, wherein each of the zone chambers comprises a respective removable perforated panel insert that is installed in the chamber and is passed through by the steam.

3. The steam blower box according to claim 1, wherein a plurality of the zone chambers have a common removable steam exit panel.

4. The steam blower box according to claim 3, wherein at least some of the perforated panel inserts are each fixed individually to a respective steam exit panel.

5. The steam blower box according to claim 1, wherein the steam exit panel is oriented with respect to the web travel path such that they define together a vaporization chamber.

6. The steam blower box according to claim 5, wherein the vaporization chamber is wedge-shaped in cross-section, having a wedge point which is oppositely directed to the web travel direction.

7. The steam blower box of claim 1, further comprising conduits for supplying steam to the zone chambers from a steam source; a steam chamber through which the conduits pass and in which the zone chambers are located and which is exposed to heating steam for heating the zone chambers and the steam supply conduits, the steam supply to the steam chamber being separate from the steam supply through the conduits to the zone chambers.

* * * * *